US007472673B2

(12) United States Patent
Liebert

(10) Patent No.: US 7,472,673 B2
(45) Date of Patent: Jan. 6, 2009

(54) CYLINDER SLEEVE SUPPORT FOR AN INTERNAL COMBUSTION ENGINE

(75) Inventor: Jeffrey W. Liebert, New Salisbury, IN (US)

(73) Assignee: Electromechanical Research Laboratories, Inc., New Albany, IN (US)

( * ) Notice: Subject to any disclaimer, the term of this patent is extended or adjusted under 35 U.S.C. 154(b) by 0 days.

(21) Appl. No.: 11/752,656

(22) Filed: May 23, 2007

(65) Prior Publication Data

US 2007/0215092 A1 Sep. 20, 2007

Related U.S. Application Data

(63) Continuation of application No. 10/624,876, filed on Jul. 22, 2003, now Pat. No. 7,234,433.

(60) Provisional application No. 60/472,589, filed on May 22, 2003.

(51) Int. Cl.
*F02F 1/42* (2006.01)

(52) U.S. Cl. ..... 123/193.3; 123/193.2

(58) Field of Classification Search ... 123/193.1–193.3, 123/193.5, 19.3; 277/505, 594
See application file for complete search history.

(56) References Cited

U.S. PATENT DOCUMENTS

| | | | | |
|---|---|---|---|---|
| 1,968,449 A | | 7/1934 | Hefti | |
| 2,279,671 A | | 4/1942 | Ford | |
| 3,653,369 A | * | 4/1972 | Fangman et al. | 123/193.3 |
| 3,714,931 A | | 2/1973 | Neitz et al. | |
| 3,765,385 A | * | 10/1973 | Conrad | 123/41.84 |
| 3,800,751 A | | 4/1974 | Glassey et al. | |
| 3,853,099 A | | 12/1974 | Feather et al. | |
| 4,211,205 A | * | 7/1980 | Lockhart | 123/193.3 |
| 4,305,348 A | | 12/1981 | Martin | |
| 4,419,971 A | | 12/1983 | Nakamura et al. | |
| 4,524,498 A | | 6/1985 | Hartsock | |
| 4,796,572 A | | 1/1989 | Heydrich | |
| 5,005,469 A | | 4/1991 | Ohta | |
| 5,150,668 A | | 9/1992 | Bock | |
| 5,343,837 A | | 9/1994 | Ward et al. | |
| 5,575,251 A | | 11/1996 | Bock | |
| 5,582,144 A | | 12/1996 | Mizutani | |
| 5,603,515 A | | 2/1997 | Bock | |
| 5,645,019 A | * | 7/1997 | Liang et al. | 123/90.11 |
| 6,145,481 A | | 11/2000 | Bock et al. | |
| 6,336,639 B1 | | 1/2002 | Ishida et al. | |
| 6,357,758 B1 | | 3/2002 | Zurfluh | |
| 6,439,173 B1 | | 8/2002 | Chung | |
| 6,532,915 B2 | | 3/2003 | Thompson | |

* cited by examiner

*Primary Examiner*—M. McMahon
(74) *Attorney, Agent, or Firm*—Finnegan, Henderson, Farabow, Garrett & Dunner, L.L.P.

(57) ABSTRACT

The disclosed multi-cylinder, poppet-valved engine, has replacement cylinder sleeves larger than the original sleeves, and laterally supported near their upper ends by an aluminum alloy plate having a continuous flange or boss projecting into the cylinder block. The flange has an inner perimeter surface having a profile fittingly engaging upper exterior cylindrical surfaces of the sleeves providing lateral support to the sleeves and heat transfer from the sleeves to coolant and to the block.

16 Claims, 8 Drawing Sheets

CYLINDER SLEEVE SUPPORT FOR AN INTERNAL COMBUSTION ENGINE

CROSS REFERENCE TO RELATED APPLICATIONS

The present application is a continuation of U.S. patent application Ser. No. 10/624,876 filed Jul. 22, 2003 now U.S. Pat. No. 7,234,433, which claims the benefit of U.S. Provisional Patent Application No. 60/472,589 filed May 22, 2003, the contents of which are hereby incorporated by reference in their entirety. Any disclaimer that may have occurred during the prosecution of the above-referenced application(s) is hereby expressly rescinded.

FIELD OF THE INVENTION

The present invention generally relates to internal combustion engines, and more particularly relates to devices and methods for supporting one or more cylinder sleeves in an internal combustion engine.

BACKGROUND OF THE INVENTION

A traditional type of internal combustion engine utilizes a cylinder and reciprocating piston arrangement. A variable-size combustion chamber is typically formed with a cylinder that is effectively closed at one end and has a moveable piston at the other end. A combustible gas, or mixture of a combustible fluid and air, is introduced into the combustion chamber and then typically compressed by the piston and ignited. The ignited gas, or mixture, exerts a force on the piston in the direction that increases the volume of the combustion chamber. The linear movement of the moving piston is then converted to rotational movement by connecting the piston to a crankshaft.

A typical internal combustion engine design includes an engine block that encases the combustion cylinders. Many designs utilize engine block materials that are not well-suited for use as the walls of the combustion cylinder. Thus, cylinder sleeves fabricated from a material that is more suitable to withstand the environment associated with the combustion chamber are used to define the cylinder walls. A common problem with cylinder sleeves, however, is their tendency to deteriorate, especially near the top of the cylinder when the sleeve extends beyond the support limits of the engine block. Previous inventions have attempted to support the upper portion of the cylinder sleeve using ring-shaped "block guards." However, block guards create problems with heat transfer and restriction of circulating cooling fluid about the cylinder sleeve, and particularly about the upper portion of the cylinder sleeve adjacent the block guard.

Currently, there is an interest among certain automobile enthusiasts in converting a conventional passenger car into a performance car. One approach is to increase power of the existing engine by increasing the diameter of the combustion cylinder and/or stroke displacement. Another approach is to increase power of the existing engine by replacing the existing cylinder sleeves with cylinder sleeves able to withstand higher stresses. The present invention facilitates this approach via an apparatus and method by which cylinder sleeves larger and/or stronger than those originally employed in an existing engine may be provided for support and cooling for increased longevity.

Thus, there is a general need in the industry to provide improved devices and methods for supporting one or more cylinder sleeves in an internal combustion engine. The present invention meets this need and provides other benefits and advantages in a novel and unobvious manner.

SUMMARY OF THE INVENTION

The present invention relates generally to improved devices and methods for supporting one or more cylinder sleeves in an internal combustion engine. While the actual nature of the invention covered herein can only be determined with reference to the claims appended hereto, the invention can be described briefly and broadly as improving the power and durability potential of a conventional internal combustion reciprocating piston engine by installing more durable replacement cylinder sleeves, and supporting upper ends of the replacement sleeves laterally with a unique plate having a flange, or boss, with a sleeve-supporting surface providing lateral support for the sleeves, and transferring heat from the sleeves to the engine coolant.

DESCRIPTION OF THE ILLUSTRATED EMBODIMENTS

Figure 1:
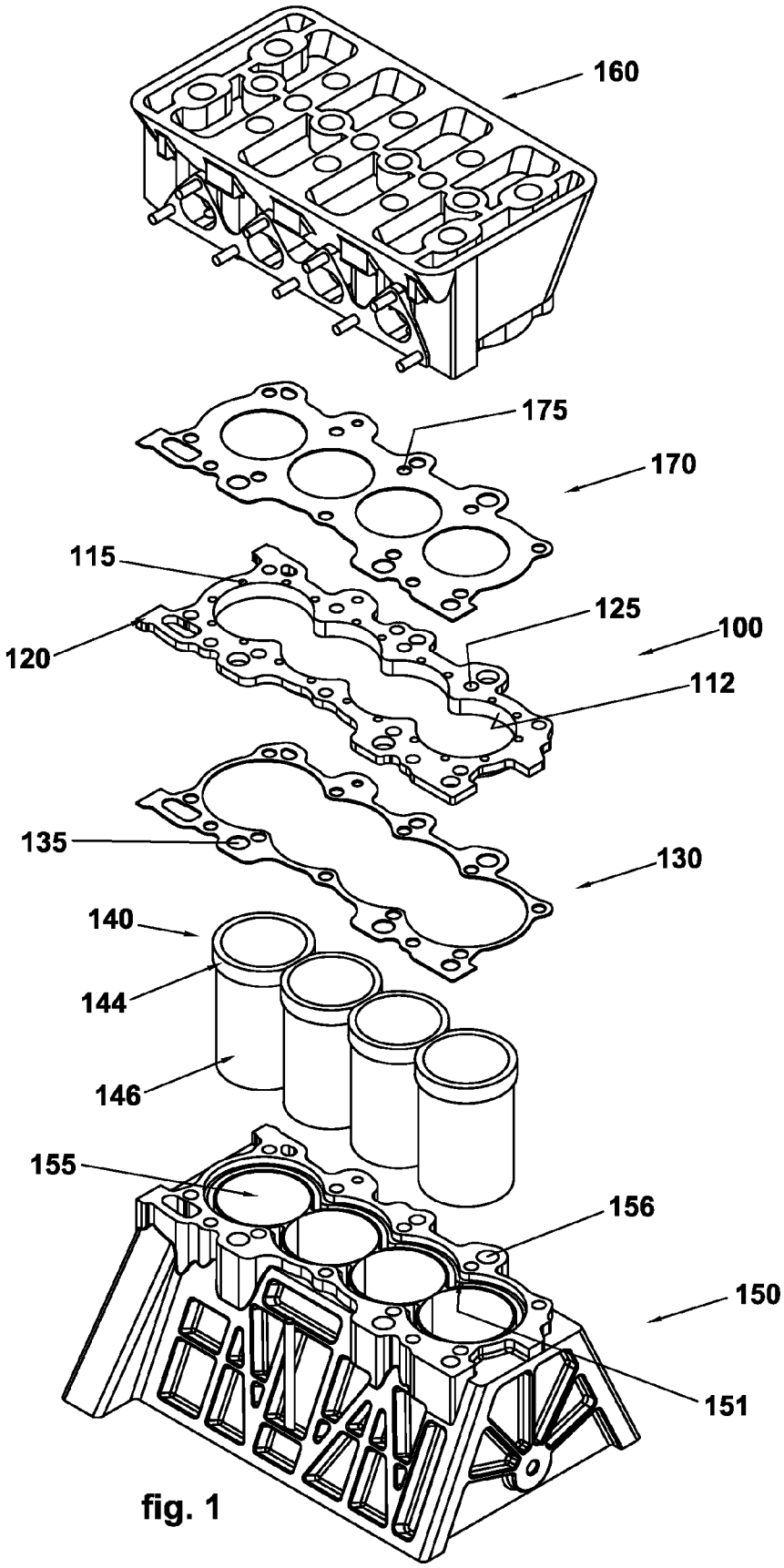
FIG. 1 is an exploded view of a portion of an internal combustion engine, including a cylinder sleeve support plate according to one embodiment of the present invention.
Figure 2:
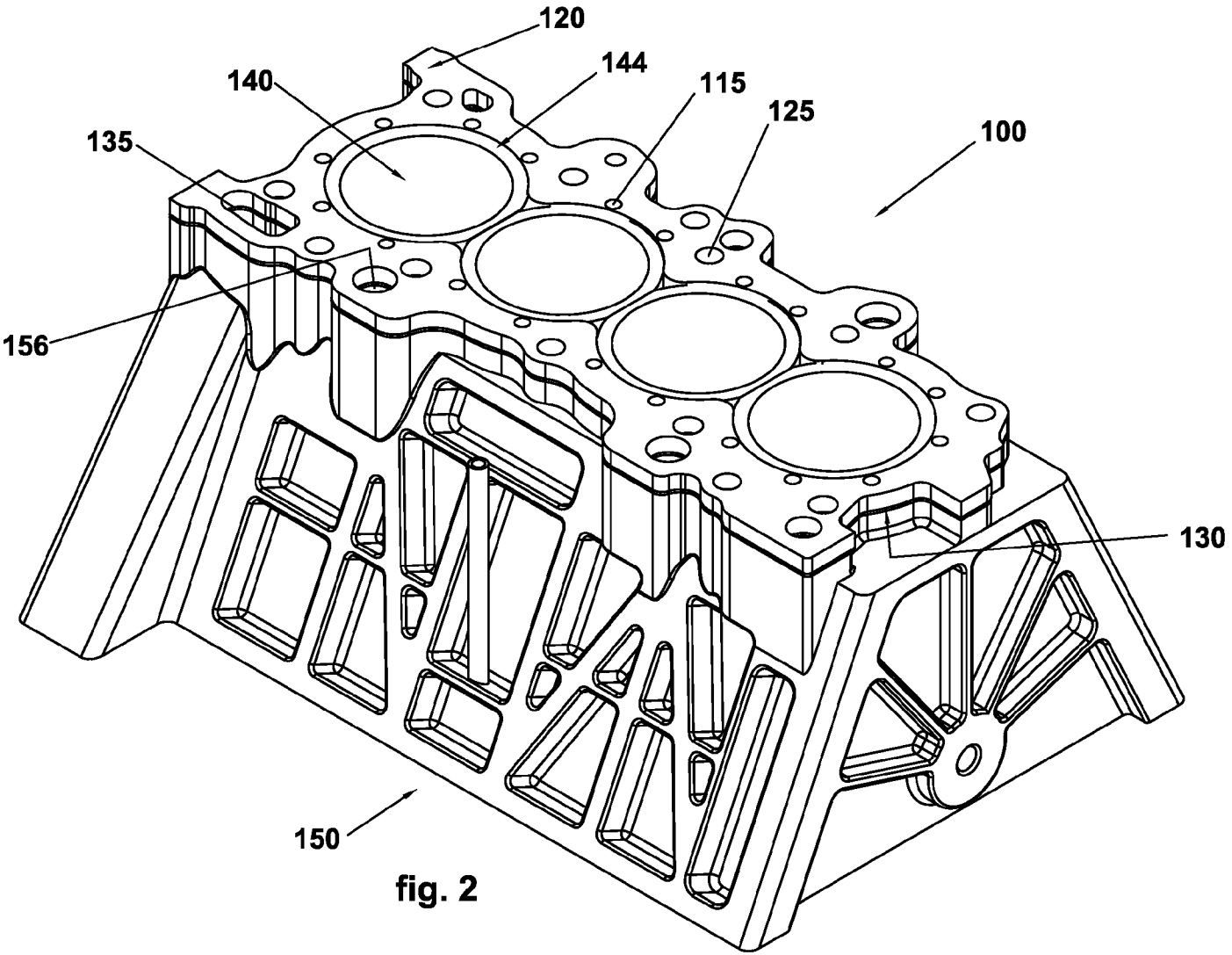
FIG. 2 is an assembled perspective view of the engine components illustrated in FIG. 1, with the engine head and head gasket removed for clarity.
Figure 3:
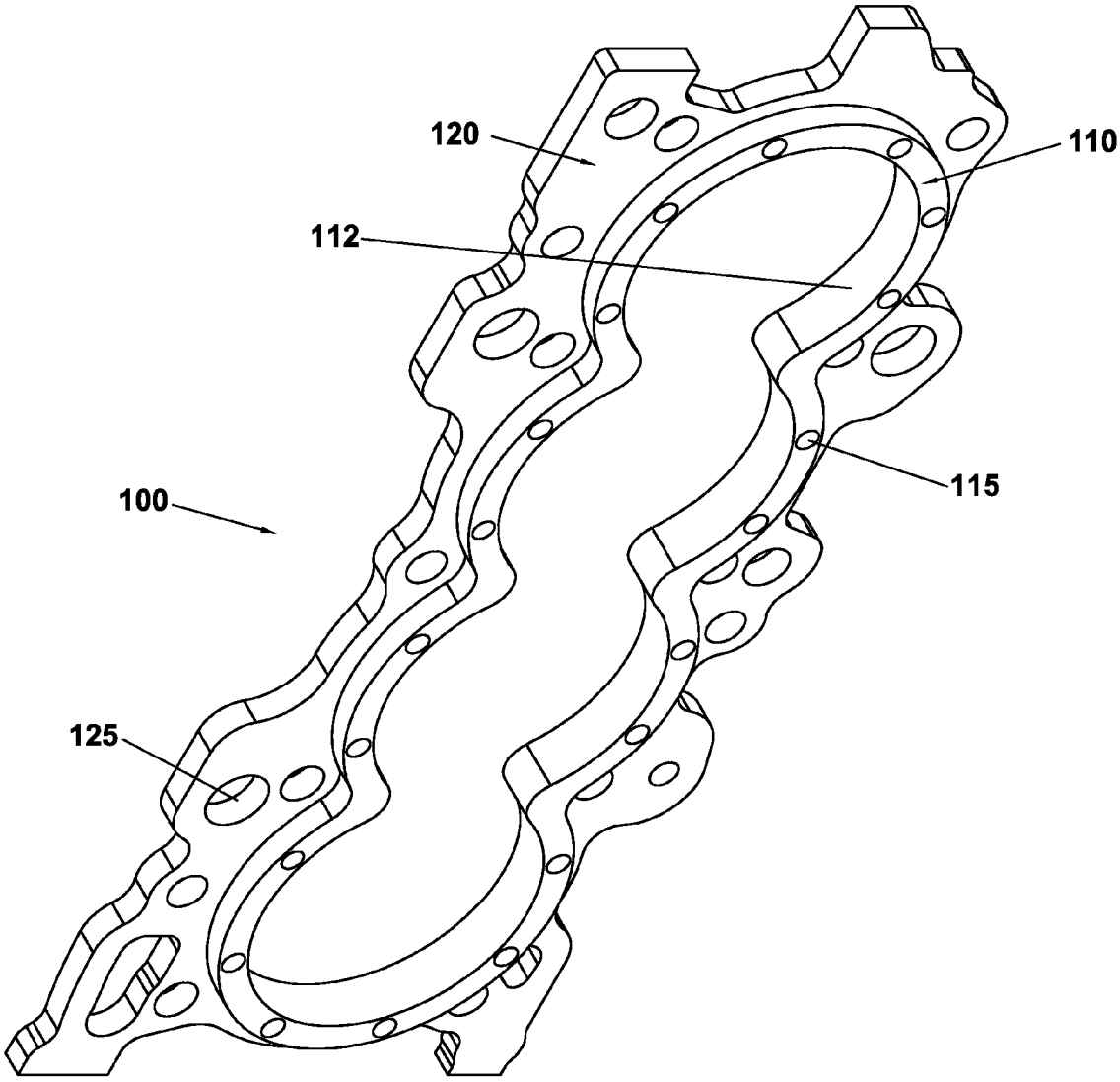
FIG. 3 is a bottom perspective view of the cylinder sleeve support plate illustrated in FIG. 1.

For the purposes of promoting an understanding of the principles of the invention, reference will now be made to the embodiments illustrated in the drawings and specific language will be used to describe the same. It will nevertheless be understood that no limitation of the scope of the invention is hereby intended, such alterations and further modifications in the illustrated devices, and such further applications of the principles of the invention as illustrated herein being contemplated as would normally occur to one skilled in the art to which the invention relates.

Referring to FIGS. 1-5, illustrated therein are select components of an open deck type internal combustion engine including a cylinder sleeve support plate 100 according to one embodiment of the present invention. The engine block 150 has four cylinder bores 155 into which respective cylinder sleeves 140 are placed. It should be understood, however, that the present invention is also applicable to engine blocks having less than or greater than four cylinders bores. The bores 155 may be formed by drilling out the original cylinder sleeves and/or the cylinder bores in the block 150, or may alternatively comprise the original cylinder bores in the block 150. Each cylinder bore 155 may have an individual and separate cylinder sleeve 140 positioned therein, or multiple cylinder bores 155 may have an array of interconnected cylinder sleeves 140 positioned therein. The cylinder sleeve 140 is comprised of lower portion 146 and upper portion 144. It should be understood that the height of the cylinder sleeve 140 may be greater than, equal to, or less than the depth of cylinder bore 155.

In one embodiment of the invention, modification of the engine block 150 includes boring out the original cylinder sleeves and/or the cylinder bores, and counter-boring the top of the cylinder bore 155 to provide an annular step or ridge 151 in the upper portion of cylinder bore 155 into which the upper portion 144 of the sleeve 140 and an annular boss portion 110 defined by the plate 100 are received. With the replacement sleeve 140 press-fitted into the cylinder bore 155, the plate 100 is then installed with the inner surface 112 of the annular boss 110 preferably fitting snugly against the upper portion 144 of the sleeve to laterally support the cylinder sleeve 140. In one embodiment of the invention, the upper surface of the engine block 150 is machined or cut down such that the upper surface of the installed support plate 100 is positioned at the original height of the upper surface of the engine block 150. In this manner, the original engine components, including the engine head, rods, etc., can be reinstalled without replacement or modification. However, it should be understood that in other embodiments of the invention, the engine block 150 need not necessarily be machined or cut down. In this manner, if desired, engine displacement may be increased beyond that of the original engine displacement by increasing the stroke and providing a longer cylinder sleeve 140 such that the upper portion of the cylinder sleeve 140 extends above the upper surface of the engine block 150.

The engine block 150 may be manufactured from various types of durable materials, such as, for example, steel, iron, aluminum or heat resistant plastics, although other materials with similar properties may also be utilized. In one embodiment of the invention, the cylinder sleeve 140 is formed of a durable, heat resistant material, such as, for example, various types of irons, including ductile and cast iron, various types of steels, including chrome alloy steel, or certain types of ceramics. However, other suitable materials may also be utilized. Additionally, the cylinder sleeve 140 may be formed of more than one material, such as, for example, a metal alloy material or a metal coated with a ceramic material.

Figure 4:
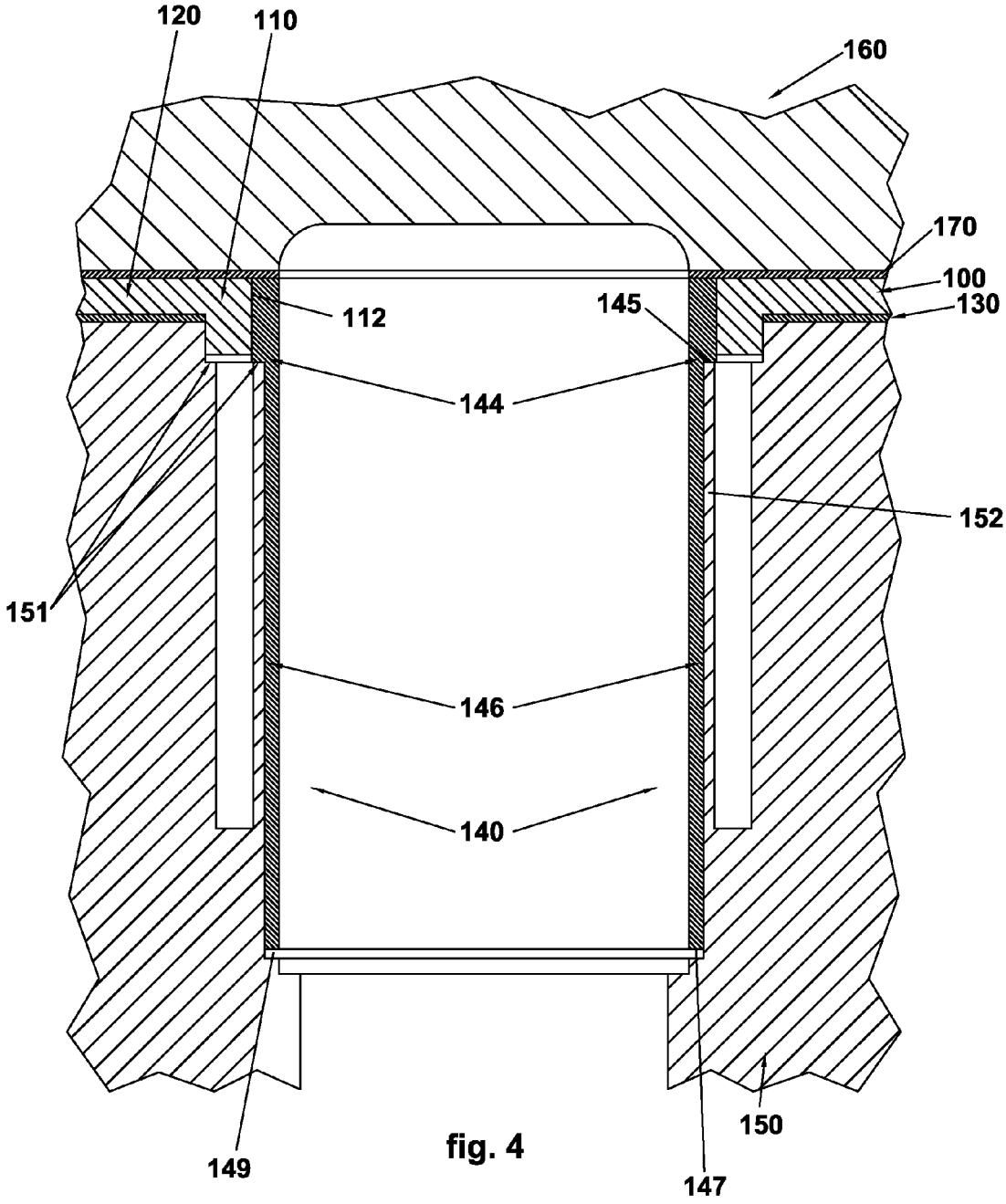
FIG. 4 is an enlarged cross-sectional view taken through one of the combustion cylinders of an engine assembled with the engine components illustrated in FIG. 1.
Figure 5:
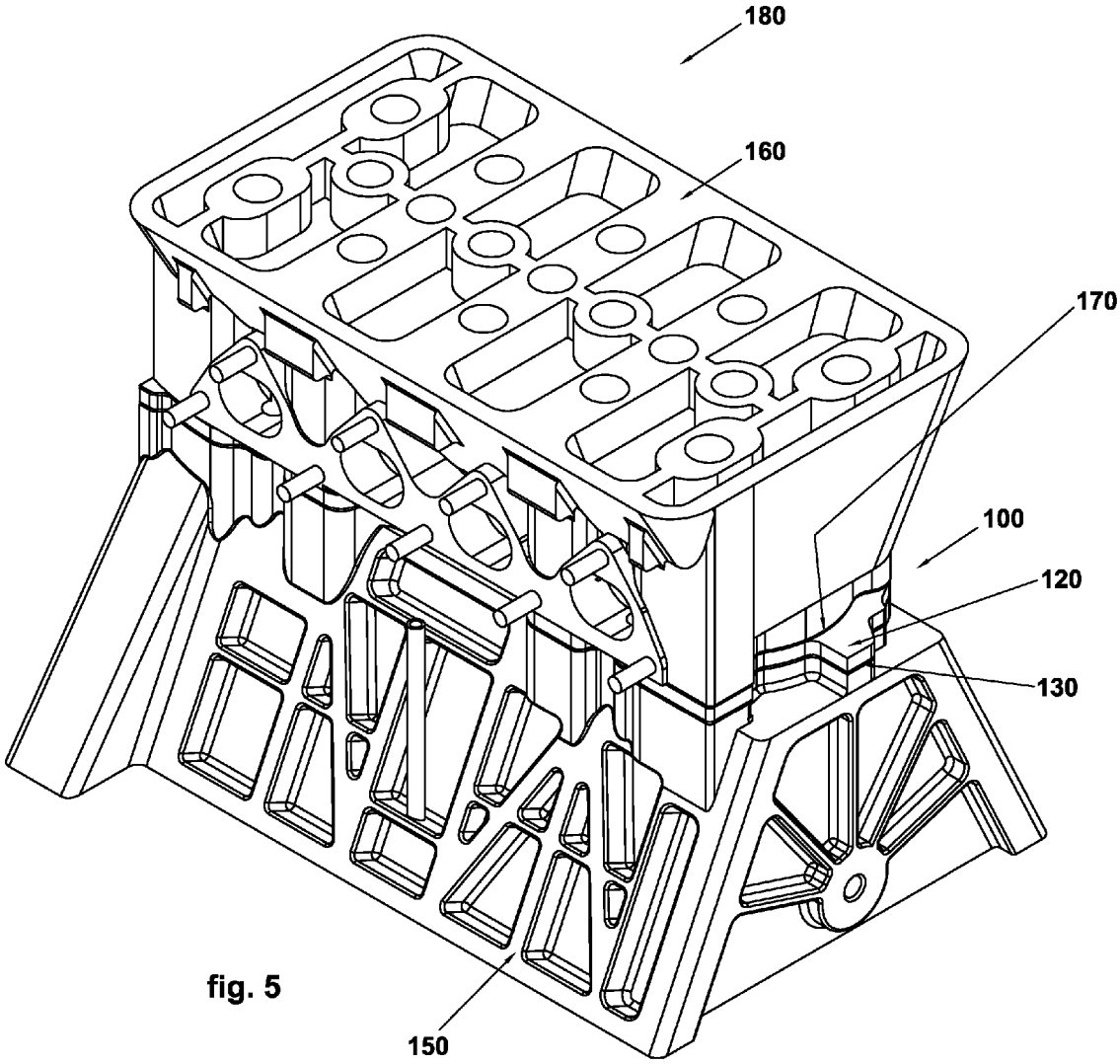
FIG. 5 is a perspective view of said engine assembled with the components illustrated in FIG. 1.

The cylinder sleeve 140 is preferably press-fitted into the bottom portion of the cylinder-can wall 152 of the cylinder bore 155. The upper portion of the wall 152, which defines a portion of the step 151, abuts against the lower surface 145 of the upper portion 144 of the sleeve, while a small vertical gap 149 is created between the lower surface 147 of the sleeve and the engine block 150. The small gap 149 between lower surface 147 of the sleeve and the engine block 150 enables reliable, consistent engagement of the lower surface 145 of the sleeve upper portion 144 with the step 151 of the cylinder-can wall. The gap 149 additionally accommodates thermal expansion and contraction of the cylinder sleeve 140 and the upper portion of block 150, thereby avoiding, or at least minimizing, interference between the lower surface 147 of the sleeve and the engine block 150 (FIG. 4). However, in other embodiments of the invention, the gap 149 may be eliminated if so desired.

Since the cylinder-can wall 152 may be relatively thin, the wall 152 may buckle when the engine is assembled and when the wall 152 is axially compressed. To avoid buckling, the wall 152 may be secured to the cylinder sleeve 140 via a fastening compound, such as, for example, a glue, epoxy, cement, molten metal, or other material that would occur to one of skill in the art.

A lower gasket 130 is mounted on the top of engine block 150. The lower gasket 130 may contain numerous openings 135 to accommodate the flow of lubricating fluids, cooling fluids and/or the passage of mounting hardware utilized to hold the engine assembly together. The lower gasket 130 provides the sealing between the sleeve support plate 100 and the engine block 150 while allowing limited relative vertical movement therebetween. The lower gasket 130 includes raised embossment portions (such as known in the art, so not depicted in the drawings) around the various openings 135 to contain fluid within such passageways as formed by openings 156, 135 and 125. The lower gasket 130 may be formed of various materials, such as, for example, stainless steel, stainless spring steel, steel coated with materials such as silicone, wood fiber products, metal, plastic, rubber, or other materials that would occur to one of skill in the art.

The sleeve support plate 100, according to the illustrated embodiment of the invention, is placed over the lower gasket 130. The base portion 120 is mounted on top of the lower gasket 130, with the extended boss portions 110 of the plate abutting the inner edge of the generally elongated central opening in the lower gasket 130 (FIG. 4). Cooling fluid may be circulated about the cylinder-can wall 152 to provide cooling to the cylinder sleeve 140. A small gap may exist between the boss 110 and the step portion 151 to allow thermal vertical expansion and contraction of the plate 100 and the boss 110 without the boss 110 actually touching the step portion 151. Openings 115 defined through the boss portion 110 of the sleeve support plate 100 and openings 125 defined through the base portion 120 of the plate 100 (FIG. 3) accommodate the flow of lubricating fluids, cooling fluids and/or the passage of mounting hardware. The openings 115 and 125 may be formed by a drilling operation and/or during the process of casting the sleeve support plate 100.

The outer shape of the base portion 120 of the plate 100 preferably corresponds to the shape of the outer portion of the engine block 150 to which sleeve support plate 100 mounts. However, other shapes and configurations of the base portion 120 are also contemplated as falling within the scope of the present invention.

The boss portion 110 has an inner perimeter surface 112 having a profile to fit snugly against the upper portion 144 of the sleeves when the engine is assembled. The inner surface 112 laterally supports the upper portion 144 of the sleeves, thereby providing the sleeve portions 144 with such support around a substantial portion of their circumferences to prevent excessive wear and degradation, including cracking and deformation, and this prevents progression of such wear and tear to lower portions 146 of the sleeves.

The placement of numerous openings 115 in the plate 100 near upper portion 144 of the sleeve aids in cooling the upper portion 144 of the sleeve and the cylinder sleeve 140. Additionally, the material comprising the plate 100 may facilitate cooling of the cylinder sleeve 140 provided that a good heat conducting material is utilized, such as, for example, an aluminum material. In one preferred embodiment, the plate 100 is comprised of a material that has a heat transfer coefficient greater than the heat transfer coefficient of the cylinder sleeve. Example materials are 7075-T6 aluminum alloy with a coefficient of thermal conductivity of 247 comprising the sleeve support plate 100 and ductile iron with a coefficient of thermal conductivity of 36 comprising the cylinder sleeve 140.

An upper head gasket 170 may be positioned above the plate 100. The head gasket 170 may contain numerous openings 175 to accommodate the flow of cooling fluid and/or the passage of mounting hardware utilized to hold the assembled engine together. The head gasket 170 functions to seal potential gaps between the engine head 160, the plate 100, and the cylinder sleeve 140. The head gasket 170 may be formed of various materials, such as, for example, stainless steel, or other materials that would occur to one of skill in the art. An example head gasket 170 is an off-the-shelf gasket manufactured by Cometric Gasket, part number C4231HP. The portion of the C4231HP head gasket mounted between the plate 100 and the engine head 160 includes an inner layer of stainless spring steel sandwiched between two layers of steel where the two layers of steel are coated with silicone. The inner stainless spring steel layer includes raised embossment portions near openings 175 to help contain fluid within the passageway formed by openings 125, 175 and openings in engine head 160 aligned with openings 125 and 175. The portion of the C4231HP head gasket which is between the cylinder sleeve 140 and the engine head 160 is comprised of similar stainless steel material, but does not contain an inner layer of stainless spring steel.

The engine head 160 is positioned above the head gasket 170 and contains openings in a lower surface thereof (not depicted) to be aligned with the openings 115, 125, 135, 156 and 175 to facilitate the flow of cooling fluid between various engine components and to provide passages through which mounting hardware may be placed to secure the engine together. Additionally, the head may include valves, pushrods, fluid passages and camshafts as necessary.

The stresses inflicted upon cylinder sleeves in internal combustion engines are typically increased when the replacement cylinder sleeves 140 are longer than the cylinder bores 155 formed in the original engine block 150, such that the upper portions of the cylinder sleeves 140 extend above the top of engine block 150. While the longer cylinder sleeves have the advantage of increasing the available displacement of the combustion chamber, the additional stresses imposed on the upper portions of conventional cylinder sleeves that extend above the engine block may cause such cylinder sleeves to overheat and wear at an increased rate. The present invention provides an improved structure by reinforcing and supporting the cylinder sleeves of the internal combustion engine, particularly with regard to cylinder sleeves that extend above the engine block.

One consideration in internal combustion engines is to maintain compression of the upper gasket 170 between the cylinder sleeve 140 and the engine head 160. During operation of the engine, the plate 100 may tend to move slightly in a direction away from the engine head 160. The fit of the plate boss surface 112 to the upper portion 144 of the cylinder sleeve is a slight interference fit. For example, the inner diameter of the curves of surface 112 equals the outer diameter of the sleeve portions 144. Therefore, while the fit is snug, it is not rigid, so it does allow the cylinder sleeve 140 and the plate 100 to move independently of each other slightly in the vertical direction during engine operation. So it facilitates maintaining compression and sealing of the head gasket 170 between the cylinder sleeve 140 and the engine head 160, even if the plate 100 moves slightly in the vertical direction relative to the head and/or block.

Because of the larger area of plate 100 than that of sleeve top surfaces, it is conceivable that under some conditions, plate 100 may exert a greater total force on the upper gasket 170 than the force exerted by the cylinder sleeves 140, thereby causing a relaxation of the pressure between the cylinder sleeve 140 and the upper gasket 170 and attendant potential escape of gases from between the cylinder sleeve 140 and upper gasket 170. However, the placement of the compressible lower gasket 130 between the engine plate 100 and the engine block 150 results in the plate 100 exerting less force on the upper gasket 170 than the cylinder sleeves 140 under normal conditions. The compressible lower gasket 130 also allows the plate 100 to move slightly in relation to the engine block 150, thereby further enabling the plate 100 and the sleeve 140 to move independently in the vertical direction.

It is preferable that the lower gasket 130 is configured and arranged such that the top of plate 100 will be positioned slightly below the top of the cylinder sleeve 140 by about 0.002 inches when the lower gasket 130 is fully compressed during operation of the assembled engine 180. Thus, the head-to-plate gasket compression at the head-to-sleeve-top location will be adequate to seal the combustion chamber's high pressure, while the head-to-plate and plate-to-block compression remains adequate to seal lubricating and cooling fluids.

The engine head 160, the upper gasket 170, the sleeve support plate 100, the lower gasket 130 and the engine block 150 may be sequentially mounted together using mounting hardware to assemble the engine 180. Various types of hardware (not depicted) may be utilized to hold the respective parts and components of engine 180 together, including, for example, bolts, screws, clips and clamps.

Figure 6:
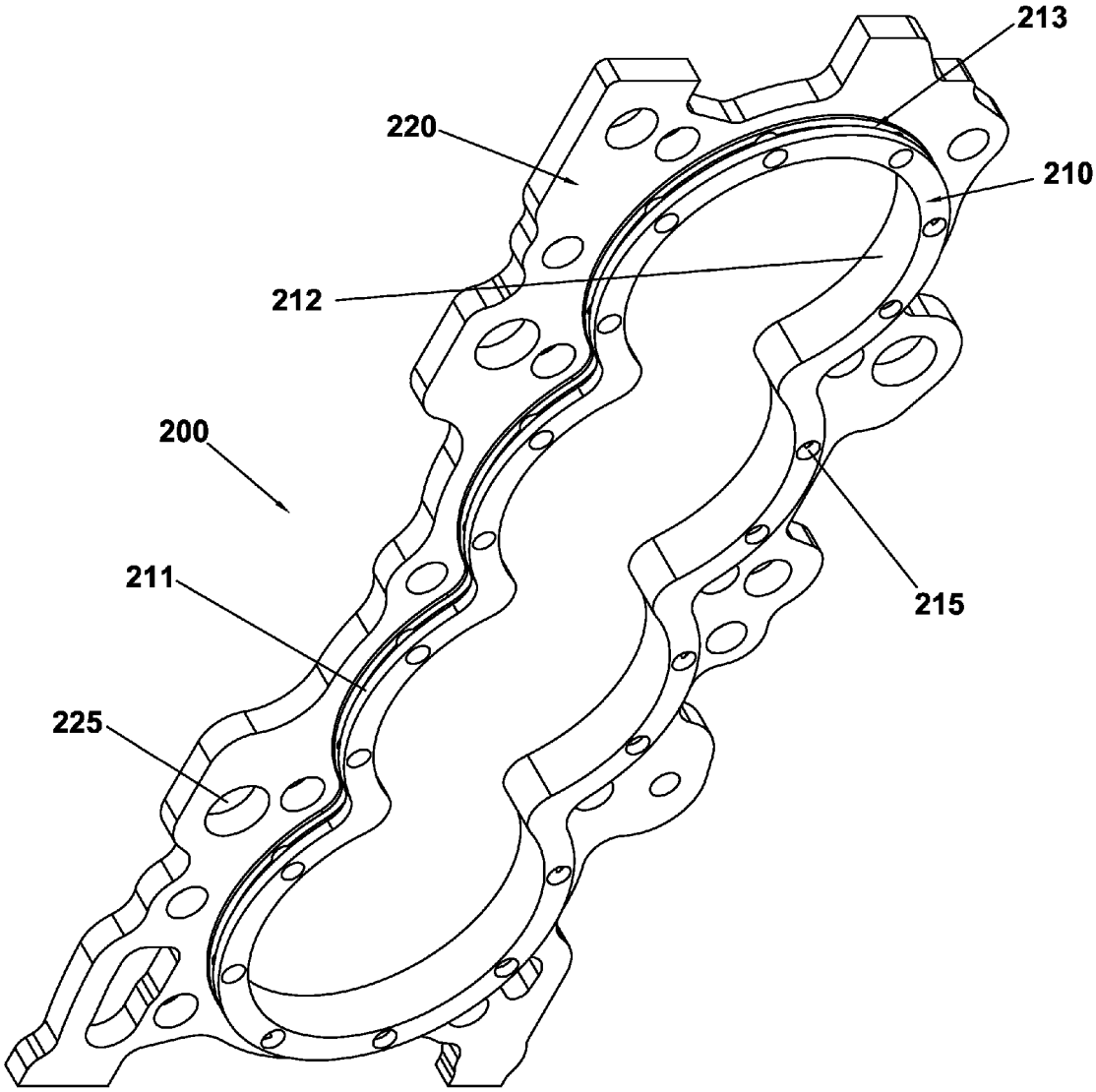
FIG. 6 is a bottom perspective view of a cylinder sleeve support plate according to another embodiment of the present invention.
Figure 7:
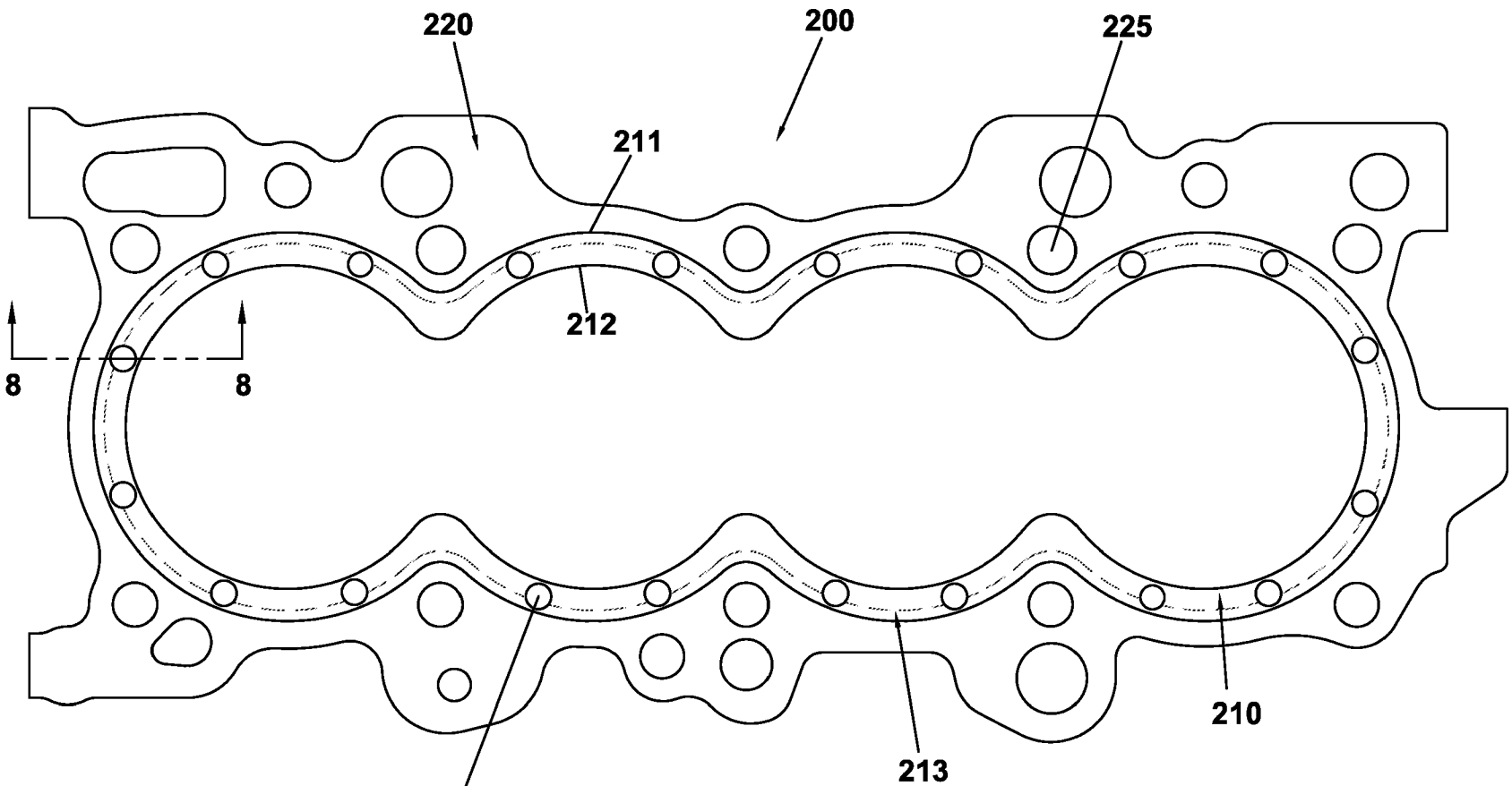
FIG. 7 is a bottom plan view of the cylinder sleeve support plate illustrated in FIG. 6.
Figure 8:
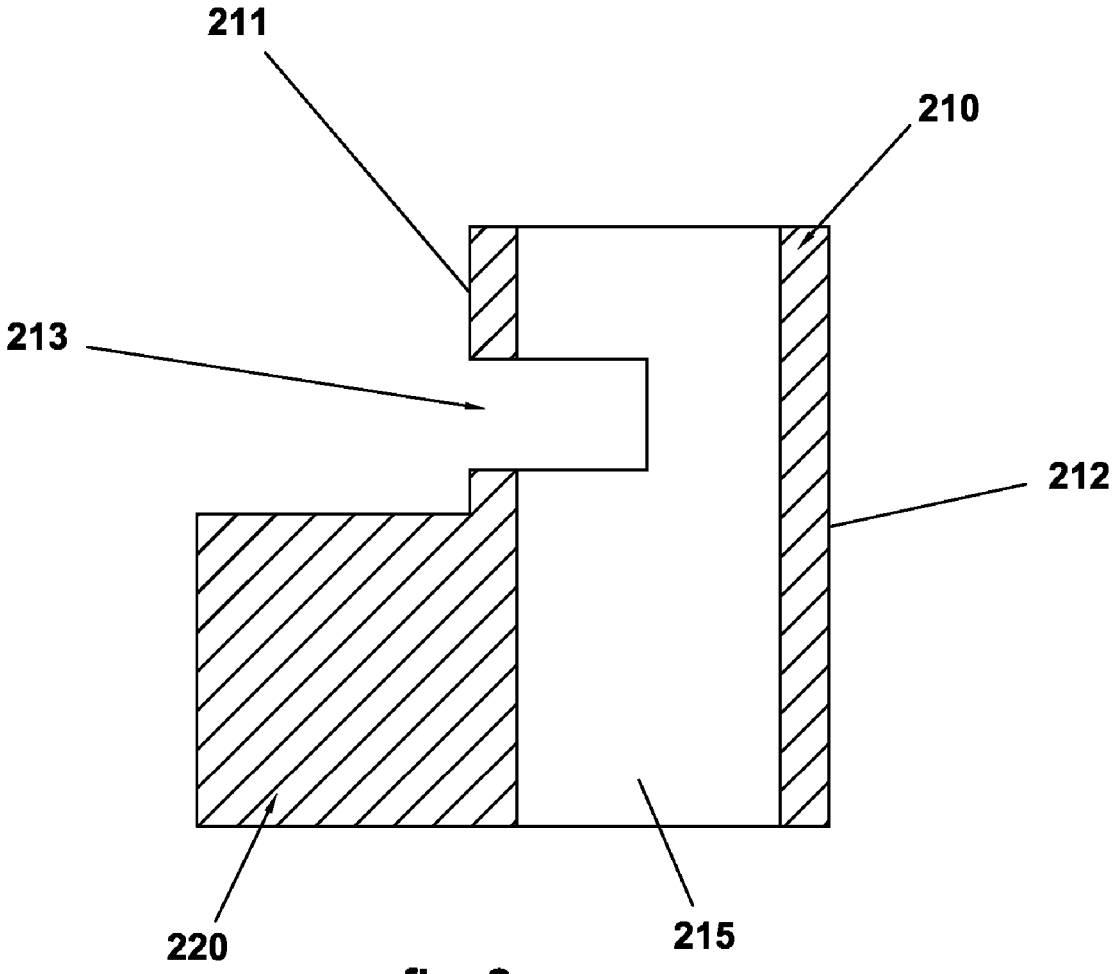
FIG. 8 is a cross-sectional view of a portion of the cylinder sleeve support plate illustrated in FIG. 7, taken along line 8-8 of FIG. 7.

Referring to FIGS. 6-8, shown therein is a cylinder support plate 200 according to another embodiment of the present invention. In many ways, the plate 200 is similar to that of the plate 100 illustrated and described above. The plate 200 includes an extended boss portion 210 and a base portion 220. The boss portion 210 defines openings 215 and the base portion 220 defines openings 225 through which lubricating and cooling fluids may flow or mounting hardware may be placed. The boss portion 210 has a recessed groove portion 213, or channel, cut into the outer surface 211 to allow cooling fluid movement in a generally horizontal direction when the plate 200 is assembled with an operating engine. The groove 213 communicates with, and preferably intersects, the openings 215 in the boss portion 210. Allowing horizontal fluid movement through groove 213, in addition to the vertical cooling fluid movement through the openings 215, enhances the ability of the plate 200 to transport heat away from inner surface 212 and the cylinder sleeve. Although not depicted in the figures, it is also contemplated that the groove 213 may be cut into the inner surface 212 or may comprise a hollow tube enclosed within the boss portion 210.

Although the present invention is illustrated for use in association with an open deck engine design, it should be understood that the present invention may also be used in association with other engine designs where reinforcement and/or enhancement of the cooling of the cylinder sleeves is desired. Additionally, although the present invention may be used to increase the power output of the engine by increasing the overall size of the cylinder sleeves (e.g., via increasing the diameter of the sleeve and/or the height of the sleeve), it should be understood that the present invention may also be used in association with cylinder sleeves having substantially the same diameter and/or the same height as the original cylinder sleeves or combustion chamber. Moreover, while the present invention is illustrated as being used in association with a Honda model B16 engine, it may be applied to other engines as well. In such cases, variations in the shape and configuration of the support plate and the locations of the openings extending therethrough may be tailored to the engine of interest. One example is the addition of push rod openings in the adapter plate and gaskets to accommodate engines that do not have overhead camshafts.

While the invention has been illustrated and described in detail in the drawings and the foregoing description, the same is to be considered as illustrative and not restrictive in character, it being understood that only exemplary embodiments have been shown and described and that all changes and modifications that come within the spirit of the invention are desired to be protected.

What is claimed is:

1. An apparatus for use within an internal combustion engine having an engine block with a block connection surface and a cylinder bore; an engine head with a head connection surface and a cylinder cover wherein the engine block and the engine head are connected to one another along their respective connection surfaces; a cylinder sleeve with an outer surface portion wherein the cylinder sleeve is mounted to the cylinder bore and positioned below the cylinder cover; and a reciprocating piston positioned within the cylinder sleeve wherein the piston, the cylinder sleeve and the cylinder cover define a combustion chamber; the apparatus comprising:

a plate connectable between the block connection surface and the head connection surface for substantially overlaying the block connection surface and for substantially underlaying the head connection surface, wherein said plate has a boss portion and wherein said boss portion is mounted substantially around and laterally supports the cylinder sleeve outer surface portion, and wherein said boss portion abuttingly engages the engine block.

2. The apparatus of claim 1 wherein the cylinder sleeve defines a sleeve axis and said plate is movable in the direction of said sleeve axis relative to said cylinder sleeve.

3. The apparatus of claim 1 further comprising a lower gasket positioned between said plate and the engine block.

4. The apparatus of claim 3, wherein the cylinder sleeve defines an axis, and wherein said lower gasket is compliant and enables the engine head to exert more axial force on the tops of said cylinder sleeves than on said plate during engine operation with said plate connected between the block connection surface and the head connection surface.

5. The apparatus of claim 3 further comprising:

a head gasket, wherein the cylinder sleeve has a sleeve upper surface portion and said head gasket is positioned between said sleeve upper surface portion and the engine head, and said head gasket is further positioned between said plate and the engine head, and wherein said lower gasket is more compliant than said head gasket, said lower gasket accommodating limited relative movement between said plate and said block.

6. The apparatus of claim 3 further comprising:

a head gasket, wherein the cylinder sleeve has a sleeve upper surface portion and said head gasket is positioned between said sleeve upper surface portion and the engine head, and said head gasket is further positioned between said plate and the engine head, and wherein said lower gasket is more compliant than said head gasket, said lower gasket accommodating limited relative movement between said plate and said cylinder sleeve.

7. The engine of claim 1 and wherein said plate and said boss are one homogeneous piece of material.

8. The apparatus of claim 3 wherein the boss portion has an outer surface abutting said lower gasket.

9. An apparatus for supporting at least one cylinder sleeve in a reciprocating piston internal combustion engine having an engine block and an engine head, wherein the cylinder sleeve has a sleeve outer surface portion, the apparatus comprising:

a support member securable between the engine block and engine head and having a base portion and a boss portion and wherein said boss portion laterally supports the cylinder sleeve outer surface portion, and wherein said boss portion abuttingly engages the engine block.

10. The apparatus of claim 9 wherein the cylinder sleeve defines a sleeve axis and said support member is movable in the direction of said sleeve axis relative to the cylinder sleeve.

11. The apparatus of claim 9 further comprising a lower gasket positioned between said support member and the engine block, with said support member secured between the engine block and the engine head.

12. The apparatus of claim 11, wherein the cylinder sleeve defines an axis, and wherein said lower gasket is compliant and enables the engine head to exert more axial force on the tops of said cylinder sleeve than on said support member during engine operation.

13. The apparatus of claim 11 further comprising:

a head gasket, wherein the cylinder sleeve has a sleeve upper surface portion and said head gasket is positioned between said sleeve upper surface portion and the engine head, and said head gasket is further positioned between said support member and the engine head, and wherein said lower gasket is more compliant than said head gasket, said lower gasket accommodating limited relative movement between said support member and said block.

14. The apparatus of claim 11 further comprising:

a head gasket, wherein the cylinder sleeve has a sleeve upper surface portion and said head gasket is positioned between said sleeve upper surface portion and the engine head, and said head gasket is further positioned between said support member and the engine head, and wherein said lower gasket is more compliant than said head gasket, said lower gasket accommodating limited relative movement between said support member and said cylinder sleeve.

15. The engine of claim 9 and wherein said support member is one homogeneous piece of material.

16. The apparatus of claim 11 wherein the boss portion has an outer surface abutting said lower gasket.

* * * * *